US007448567B2

(12) United States Patent
Roozeboom et al.

(10) Patent No.: US 7,448,567 B2
(45) **Date of Patent: *Nov. 11, 2008**

(54) APPARATUS AND METHOD FOR SUPPORTING AND RETAINING A HAMMER AND CUTTER

(75) Inventors: Keith Roozeboom, Pella, IA (US); Gary Verhoef, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/784,375

(22) Filed: Apr. 5, 2007

(65) Prior Publication Data

US 2008/0105773 A1 May 8, 2008

Related U.S. Application Data

(63) Continuation of application No. 11/030,726, filed on Jan. 6, 2005, now Pat. No. 7,204,442.

(60) Provisional application No. 60/536,433, filed on Jan. 13, 2004.

(51) Int. Cl.
*B02C 13/26* (2006.01)

(52) U.S. Cl. ..... 241/191; 241/197; 241/294

(58) Field of Classification Search ..... 241/191, 241/197, 294

See application file for complete search history.

(56) References Cited

U.S. PATENT DOCUMENTS

| | | | | |
|---|---|---|---|---|
| 380,245 | A * | 3/1888 | Creager | 241/225 |
| 3,138,338 | A * | 6/1964 | McKenna | 241/294 |
| 3,237,275 | A | 3/1966 | Middleton | |
| 3,580,517 | A | 5/1971 | Ehrlich | |
| 4,009,742 | A | 3/1977 | Ziegelmeyer | |
| 4,066,216 | A | 1/1978 | Waldrop et al. | |
| 4,131,047 | A | 12/1978 | Schriber et al. | |
| 4,927,088 | A | 5/1990 | Brewer | |
| 5,114,085 | A | 5/1992 | Inui | |
| 5,285,974 | A | 2/1994 | Cesarini | |
| 5,320,292 | A | 6/1994 | Smith | |
| 5,381,976 | A | 1/1995 | Chon et al. | |
| 5,419,502 | A | 5/1995 | Morey | |
| 5,507,441 | A | 4/1996 | De Boef et al. | |
| 5,529,249 | A | 6/1996 | Braun et al. | |
| 5,548,111 | A | 8/1996 | Nurmi et al. | |
| 5,647,419 | A | 7/1997 | Stewart | |
| 5,819,825 | A | 10/1998 | Lyman et al. | |
| 5,947,395 | A | 9/1999 | Peterson et al. | |
| 5,950,945 | A | 9/1999 | Schaller | |
| 5,971,305 | A | 10/1999 | Davenport | |
| 5,975,443 | A | 11/1999 | Hundt et al. | |

(Continued)

FOREIGN PATENT DOCUMENTS

| | | |
|---|---|---|
| EP | 1 192 997 A1 | 4/2002 |

(Continued)

*Primary Examiner*—Mark Rosenbaum
(74) *Attorney, Agent, or Firm*—Merchant & Gould P.C.

(57) ABSTRACT

A rotary drum having a cutter extending outward from the outer diameter of the rotary drum. The rotary drum further includes a sleeve. The cutter is retained in a position relative to the drum by at least one block having a surface that wedges the cutter and/or interconnected member against the sleeve.

20 Claims, 16 Drawing Sheets

U.S. PATENT DOCUMENTS

| | | | |
|---|---|---|---|
| 6,045,072 | A | 4/2000 | Zehr |
| 6,079,649 | A | 6/2000 | Balvanz et al. |
| 6,131,838 | A | 10/2000 | Balvanz et al. |
| 6,142,400 | A | 11/2000 | Balvanz et al. |
| 6,293,481 | B1 | 9/2001 | Ragnarsson |
| 6,293,491 | B1 | 9/2001 | Wobben |
| 6,299,082 | B1 | 10/2001 | Smith |
| 6,308,905 | B1 | 10/2001 | Balvanz et al. |
| 6,364,227 | B1 | 4/2002 | Dorscht |
| 6,394,376 | B1 | 5/2002 | Koenig |
| 6,394,378 | B1 | 5/2002 | Ragnarsson |
| 6,422,495 | B1 | 7/2002 | De Boef et al. |
| 6,523,768 | B2 | 2/2003 | Recker et al. |
| 7,204,442 | B2 | 4/2007 | Roozeboom et al. |
| 2001/0045478 | A1 | 11/2001 | Recker et al. |
| 2003/0127550 | A1 | 7/2003 | Stemper |

FOREIGN PATENT DOCUMENTS

| | | | |
|---|---|---|---|
| EP | 1 201 310 | A1 | 5/2002 |
| EP | 1 214 979 | A1 | 6/2002 |
| JP | 2001-190972 | | 7/2001 |
| JP | 2002-95989 | | 4/2002 |
| WO | WO 93/20942 | | 10/1993 |
| WO | WO 02/055203 | A1 | 7/2002 |

* cited by examiner

APPARATUS AND METHOD FOR SUPPORTING AND RETAINING A HAMMER AND CUTTER

CROSS-REFERENCE TO RELATED APPLICATIONS

This application is a continuation of U.S. application Ser. No. 11/030,726, filed Jan. 6, 2005; now U.S. Pat. No. 7,204,442 which application claims the benefit of U.S. Provision Application No. 60/536,433, filed on Jan. 13, 2004; which applications are incorporated herein by reference.

TECHNICAL FIELD

The principles disclosed relate to the rotary drum used for grinding or shredding material, such as waste material. More particularly, this disclosure relates to the construction of the rotary drum having replaceable wear components.

BACKGROUND

Waste material such as trees, brush, stumps, pallets, railroad ties, peat moss, paper, wet organic materials and the like are often processed with hammermill machines that generally fall into one of two categories: grinders or shredders. Grinders typically function by forcing the material into contact with a rotating drum having cutters at the outer diameter. The cutters of grinders travel at a relatively high rate of speed, typically exceeding 5000 feet per minute. Shredders typically function by forcing the material into contact with a rotating drum with cutters at the outer diameter. The cutters of shredders travel at a relatively low rate of speed, typically less than 500 feet per minute.

An example of one grinder is disclosed in commonly assigned U.S. Pat. No. 5,507,441 dated Apr. 16, 1996. Other examples of grinders are found in U.S. Pat. Nos. 5,419,502; 5,975,443; 5,947,395; and 6,299,082. Examples of shredders are found in U.S. Pat. Nos. 4,927,088; 5,971,305; and 6,394,376.

In both types of hammermill machines, the cutters are subjected to extreme loads. Although the loading differs, due to the differing speeds, the cutters in either machine can experience high rates of wear, particularly if the waste material is abrasive. For this reason the cutters are typically replaceable.

One such replaceable cutter design utilizes a through-member, as part of the basic structure of the drum, to support cutters, and is shown in commonly assigned U.S. Pat. No. 6,422,495 dated Jul. 23, 2002, which is herein incorporated by reference. FIG. 1 of the present disclosure illustrates the through-member design of U.S. Pat. No. 6,422,495. As shown in FIG. 1, the through-member 10 is supported and guided in a drum skin 20 by a sleeve 30. Cutters 40 are interconnected to the through-member 10 at each end of the through-member (only one end shown). The cutters 40 interact with shoulders 32 formed on the sleeve 30. By the interaction of cutter 40 with shoulder 32 of the sleeve 30, the through-member 10 is held in a first axial and radial position.

This interaction of the cutter 40 with the shoulder 32 (i.e. the restriction of axial and radial movement of the cutter) makes the supporting profile of shoulder 32, relative to the cutter 40, critical to the function of the machine. In this prior art design, the shoulder 32 is a part of the sleeve 30, and is not meant to be removable, as it is welded to drum skin 20. In different applications requiring different cutters, there may be a need to have various supporting cutter profiles. Thus, a need exists for a shoulder or supporting cutter profile that enables the use of a variety of cutters.

Likewise there exists a need for improved support of a through-member. It has been found that hammermill machines create significant dynamic radial loads on the cutters 40; which in turn, subject the supporting shoulders 32 of the sleeves 30 to loads sufficient to cause permanent deformations. Thus, a need exists for an improved mounting arrangement that restricts the movement of a through-member relative to a sleeve.

Alternative mounting arrangements have been used, including wedge blocks. One example of a wedge block can be found in U.S. Pat. No. 6,523,768. In this example, a drums includes pockets having a narrow outer opening with a wider inner recess, herein referred to as a closing taper. Wedges having a wide base and narrow top are installed into the pocket with a bolt. The bolt pushes against a bottom of the pocket, forcing the wedges outward to wedge against a cutter. This design requires relatively complex pocket manufacturing and assembly.

Another example of a drum that uses a wedging technique to restrain cutters is disclosed in EP 1 201 310 A1. In this example, a pair of mating hammers, each having a tapered surface, cooperate to extend from a pocket formed through a drum. The hammers have intersecting centers, and include parallel sides. The tapered surfaces of the hammers cooperate to wedge the hammers apart and force the hammers into contact with the drum. In this example, when a hammer is worn, the entire hammer needs to be replaced. The hammers are long and relatively complex. Thus, a need exists for a simpler, more cost effective mounting arrangement.

SUMMARY

One aspect of the present invention relates to rotary grinder including a cylindrical drum rotatable about an axis. The cylindrical drum includes a cylindrical wall defining an interior and an exterior of the cylindrical drum and a first and second end. A first receiving aperture and a second receiving aperture pass through the cylindrical wall from the exterior to the interior. A guide extends between the first and second receiving aperture forming a first pocket at the first aperture and a second pocket at the second aperture. Each pocket has a bottom and additionally a front side spaced apart from a rear side.

In another aspect, the present invention relates to a rotary grinder including a cylindrical drum rotatable about an axis. The cylindrical drum includes a cylindrical wall defining an interior and an exterior of the cylindrical drum and a first and second end. A first receiving aperture and a second receiving aperture each passing through the cylindrical wall from the exterior to the interior. A guide extends between the first and second receiving apertures forming a first pocket at the first aperture and a second pocket at the second aperture. Each pocket includes a front side and a rear side. A through-member is received by the guide. The through-member has a first end that extends beyond the exterior of the cylindrical wall at the first pocket and a second end opposite the first end that extends beyond the exterior of the cylindrical wall at the second pocket. A wedge member is positionable within one of the pockets. The wedge member has a first surface and a second surface, the first surface being non-parallel in relation to the second surface. When the wedge member is positioned within the one pocket, a clamping force is generated between the first side of the pocket and the through-member.

DETAILED DESCRIPTION

Figure 1:
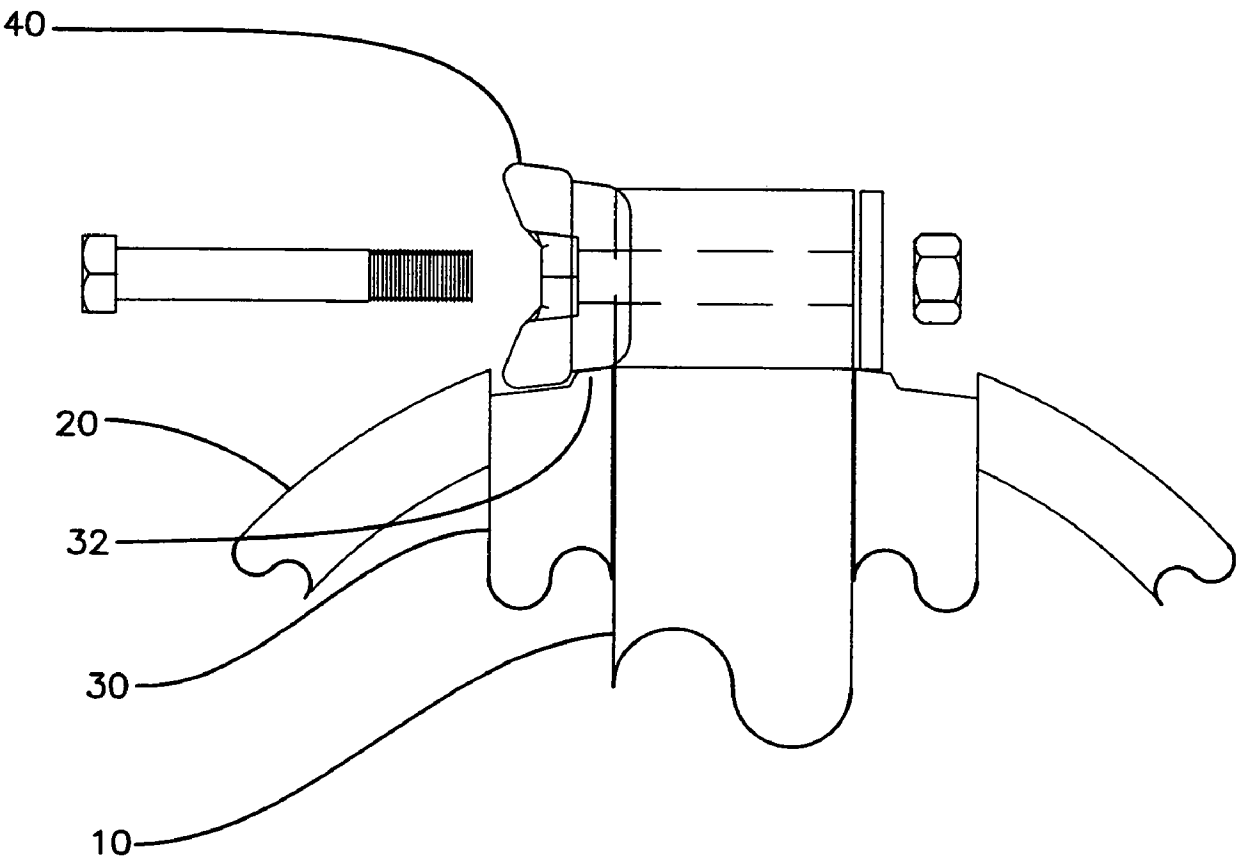
FIG.1 PRIOR ART
FIG. 1 is a side view of a prior art connection configuration for securing a cutter to a hammer of a hammermill.

With reference now to the various figures in which identical elements are numbered identically throughout, a description of various exemplary aspects of the present invention will now be provided. The preferred embodiments are shown in the drawings and described with the understanding that the present disclosure is to be considered an exemplification of the invention and is not intended to limit the invention to the embodiments disclosed.

Figure 2:
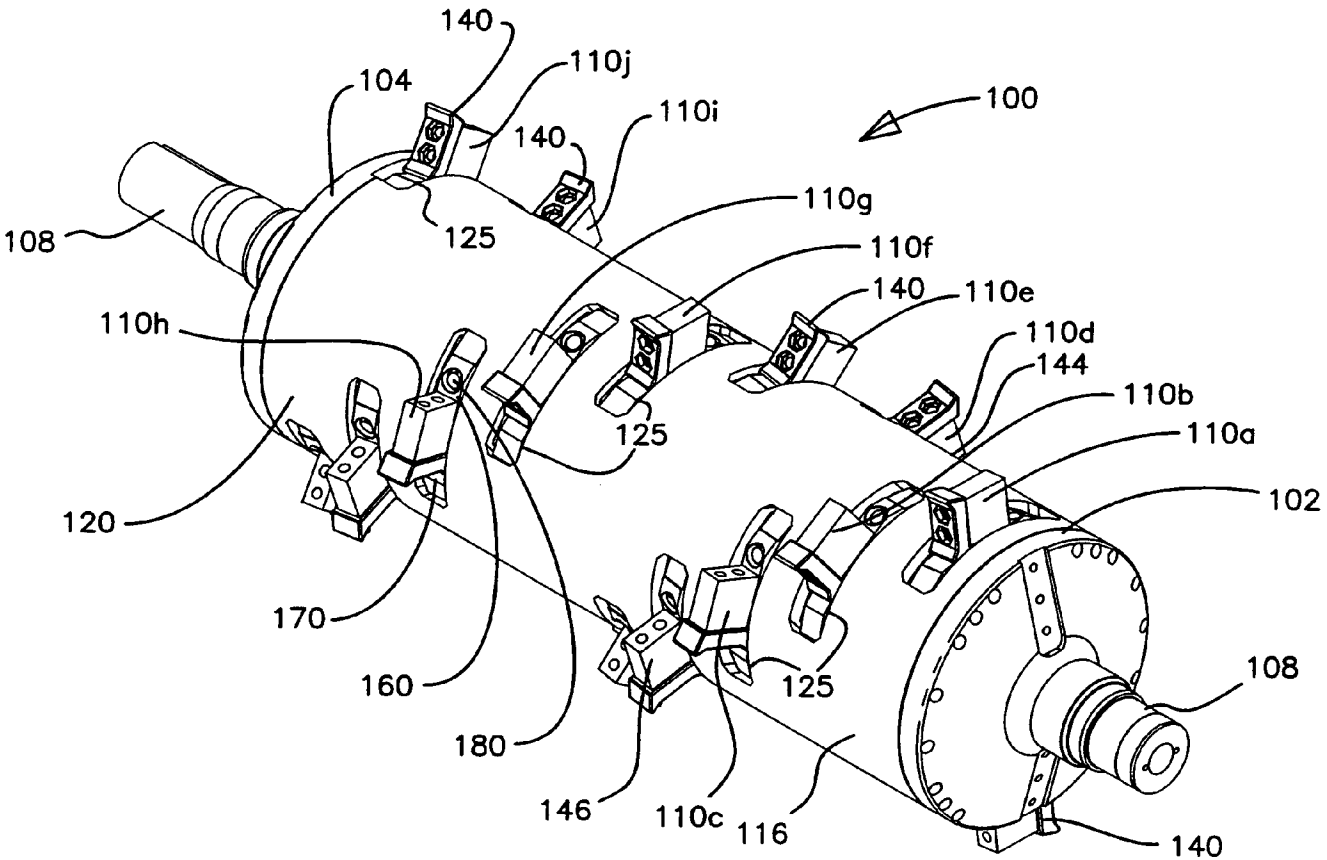
FIG. 2 is a perspective view of a drum with a first embodiment of the present invention.

Referring to FIG. 2, one embodiment of a rotary drum 100 in accord with the principle disclosed is illustrated. The rotary drum 100 includes a generally cylindrical drum skin 120, and first and second end caps 102, 104 positioned at opposite ends of the drum skin 120. Each of the end caps 102, 104 is configured to receive a shaft 108. The shaft can be a cylindrical shaft or a shaft with a non-circular cross-section, such as a hexagon shape. In the alternative, the end caps 102, 104 could be constructed with apertures sized to accept bearings, rather than a shaft, wherein the drum would be supported by a stationary shaft or stub-shafts.

Figure 3:
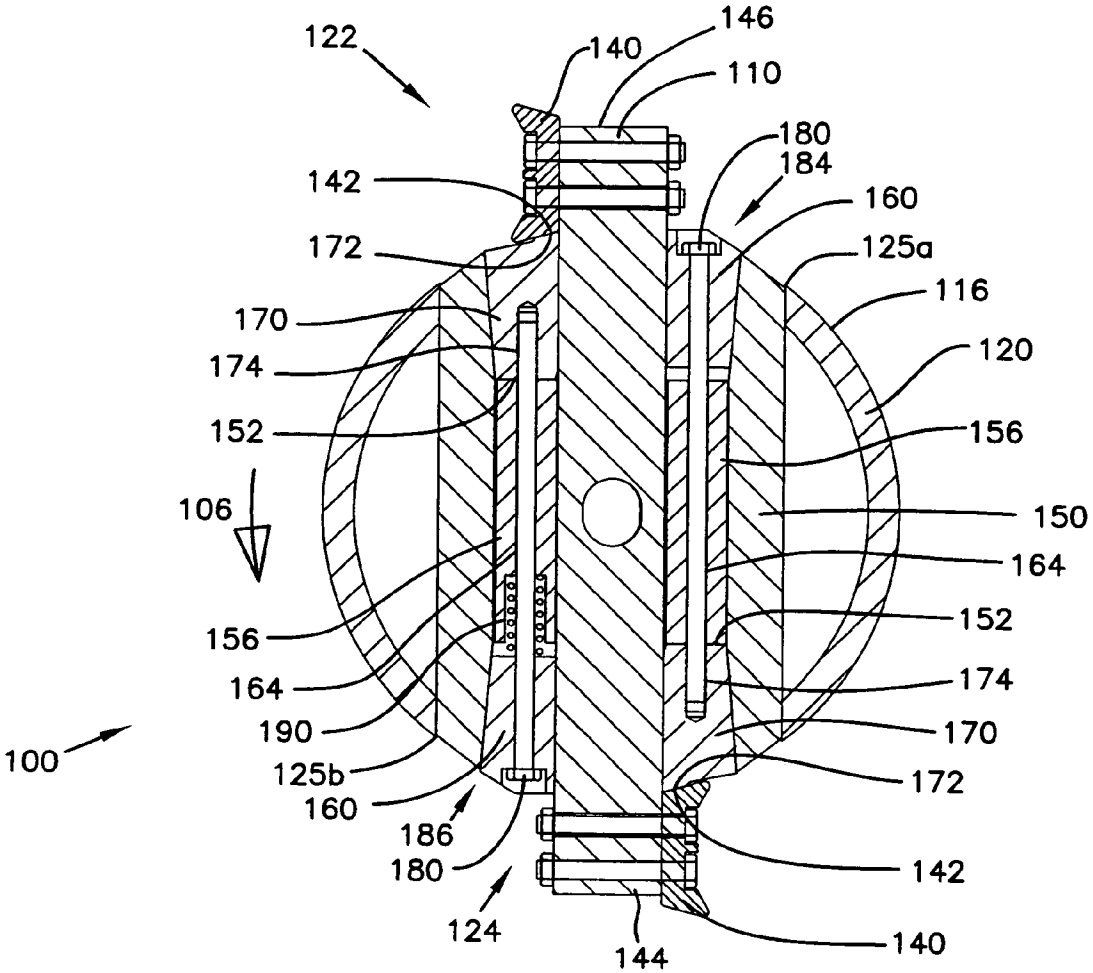
FIG. 3 is a cross-sectional view of the drum of FIG. 2, the viewing plane passing through a through-member.

The drum skin 120 defines a plurality of receiving apertures 125. The receiving apertures are arranged in pairs, including a first receiving aperture 125*a* and a second receiving aperture 125*b*, as shown in FIG. 3. A sleeve 150 is positioned adjacent to the pair of the receiving apertures 125*a*, 125*b*. The sleeve 150 defines a first pocket 184 adjacent to the first receiving aperture 125*a* and a second pocket 186 adjacent to the second receiving aperture 125*b*, as shown in FIG. 4.

Referring again to FIG. 2, the rotary drum 100 further includes a plurality of through-members 110*a*-110*j*. In the illustrated embodiment, the rotary drum 100 includes ten through-members, each of the through-members having two associated cutters 140 attached to first and second ends 144, 146 of the through-members (shown with respect to through-member 110*d*). The through-members 110 are retained in the assembly, as indicated for through-member 110*h*, by a first rear block 160 and a second front block 170.

FIG. 3 illustrates one of the through-members 110 secured in the rotary drum 100 and configured for rotation in a direction represented by arrow 106. The sleeve 150 extends from one side 122 of the drum skin to an opposite side 124 of the drum skin. The through-member 110 is positioned within the sleeve 150. A pair of front blocks 170 and a pair of rear blocks 160 secure the through-member 110 within the sleeve 150. Each of the rear blocks 160 is secured to the corresponding front block 170 by a bolt 180.

Figure 4:
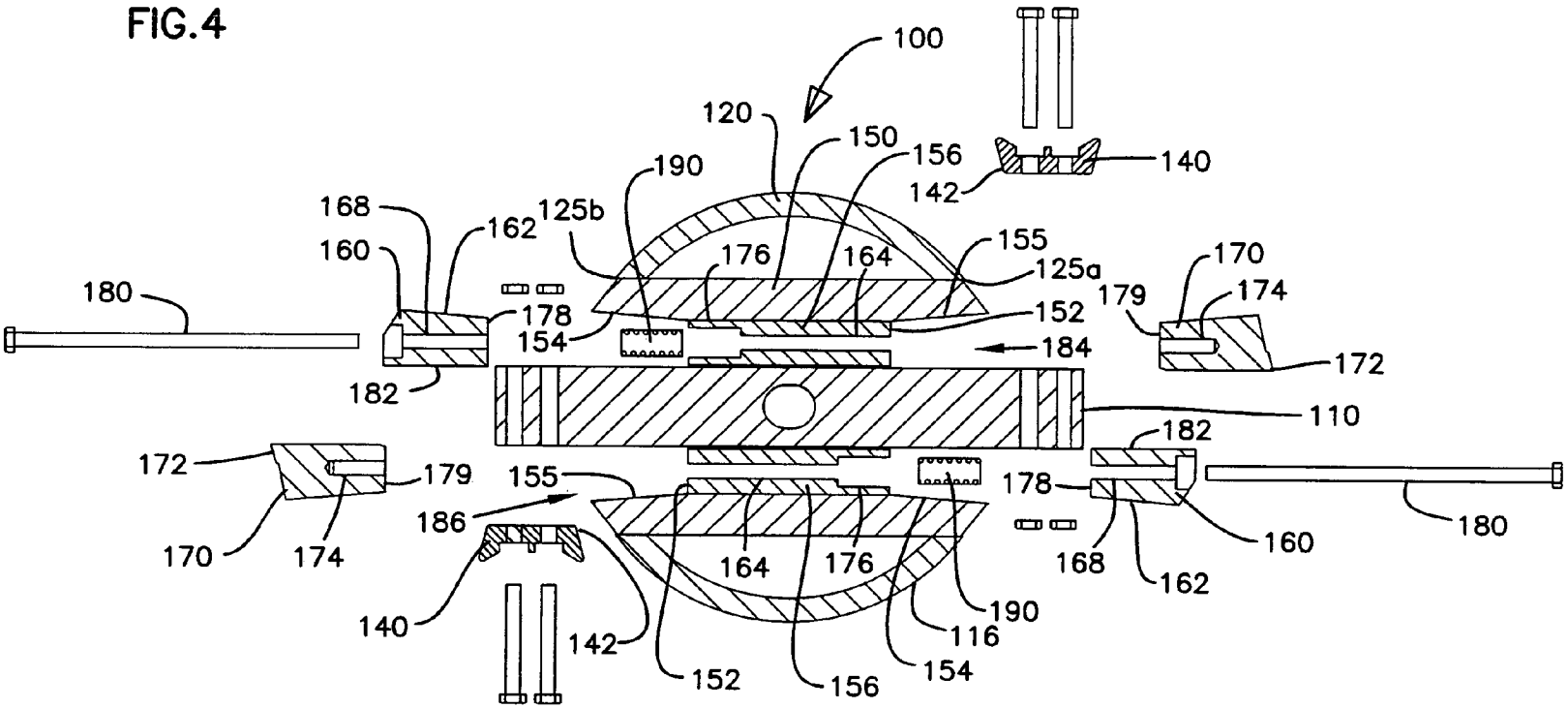
FIG. 4 is an exploded cross-sectional view of FIG. 3.
Figure 5:
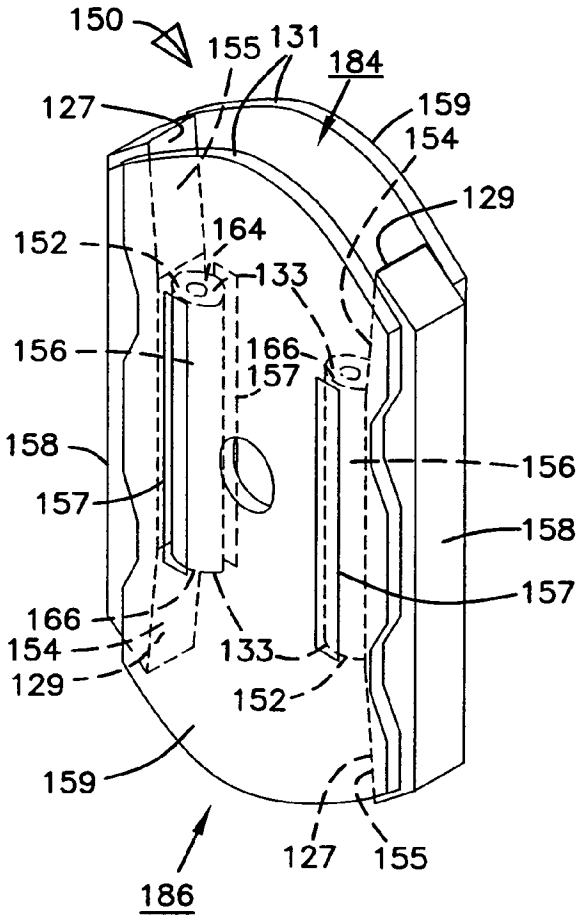
FIG. 5 is a perspective view of one embodiment of a sleeve of the present invention.

Referring now to FIGS. 4 and 5, the sleeve 150 includes outer structures 158. Sleeve plates 159 extend between and interconnected to the outer structures 158 and include slots 157. The sleeve 150 has a generally rectangular cross-section. The outer structures 158 and sleeve plates 159 define a front 127, a rear 129 and sides 131 of each of the first and second pockets 184, 186. Opposing spacers 156 are fixed to the sleeve 150 by positioning the spacers 156 adjacent to the slots 157 of the plates 159 for subsequent permanent joining, such as by weldment at the slots 157, for example. The spacers 156 are positioned such that first and second end surfaces 152, 166 at least partially define a bottom 133 of the first and second pockets 184, 186. The spacers 156 have a hole 164 extending through the spacer 156 from the first end surface 152 to the second end surface 166.

Referring back to FIGS. 3 and 4, one front block 170 is installed within each of the first and second pockets 184, 186 of the sleeve 150 adjacent to each of the first and second ends 144, 146 of the through-member 110. The front blocks 170 are inserted within the respective pockets 184, 186 of the sleeve until a bottom surface 179 of the front block contacts the first surface 152 of the spacer 156. The first surface 152 accordingly functions as a locating surface such that when both of the front blocks 170 are so installed, the through-member 110 is located in a properly centered position within the pockets 184, 186 of the sleeve 150. Cutters 140 are then secured to each of the first and second ends 144, 146 of the through-member 110.

Each of the front blocks 170 includes a supporting structure 172. The supporting structure 172 contacts a mating structure 142 of the cutter 140. In this manner, the through-member is properly located. The through-member 110 is then secured to the sleeve 150 by installing the pair of rear blocks 160. In particular, one rear block 160 is installed within each of the first and second pockets 184,186 of the sleeve 150 adjacent to each of the first and second ends 144, 146 of the through-member 110, and opposite to each of the front blocks 170. The bolts 180 are positioned through through-holes 168 formed in the rear blocks 160, and extend through the hole 164 in the spacer 156 to engage threaded holes 174 formed in the front blocks 170. As the bolt 180 threads into the front block 170, the front and rear blocks 160, 170 are pulled toward one another.

Referring now to FIG. 4, each of the outer structures 158 of the sleeve 150 includes a first tapering surface 154 and a second opposite surface 155. In the illustrated embodiment of FIGS. 3-5, the second opposite surface 155 is tapering similar to the first tapering surface 154. The tapering surfaces 154, 155 are generally non-parallel to a line passing through the center of the drum skin 120, and form what will be referred to as an opening taper. In an opening taper, the resulting opening (i.e. pocket 184, 186) defined by the opening taper is widest at an outer surface 116 of the rotary drum 100.

As shown in FIG. 5, the second tapering surface 155 is generally provided so that the overall sleeve 150 is generally symmetrical. That is, each of the second opposite surfaces 155 of one of the outer structures 158 is oriented opposite to one of the first tapering surfaces 154 of the other outer structure; each of the opposing surfaces 154, 155 having a similar tapering construction such that each of the pockets 184, 186 of the sleeve 150 is generally symmetrical.

The rear blocks 160 have a cooperating tapered surface 162 that contacts the first tapering surface 154 of the outer structures 158 of the sleeve 150. The cooperating tapered surface 162 of rear block 160 is designed to be parallel to the first tapering surface 154 of the outer structures 158 of the sleeve 150 when an opposite side 182 of the rear block 160 is in contact with through-member 110. The tapered surfaces 162 and 154 interact to generate a clamping force as the front and rear blocks 160, 170 are pulled together by the bolt 180. The clamping force results in clamping or wedging of the through-member 110 between the front blocks 170 and the rear blocks 160.

Referring still to FIGS. 3 and 4, springs 190 may be utilized to aid the assembly process of the rotary drum 120 (only one is illustrated in FIG. 3). The springs 190 assist in assembly by holding the rear blocks 160 in a position to prevent the rear block 160 from prematurely wedging against the through-member 110. The springs 190 can be positioned in bores 176 formed adjacent to the second surface 166 of the spacers 156. The springs 190 are arranged to contact a bottom surface 178 of the rear blocks 160 to bias the rear blocks radially outward from the sleeve 150. The springs 190 are sized such that the bolt 180 extends through the inner diameter of the spring 190 when the rotary drum 110 is assembled. The illustrated spring embodiment is only one of several possible types of springs that can be used in accord with the principle disclosed. Other types of springs, such as springs constructed of a rubber or polymeric material, and having other different shapes can be used.

Figure 6:
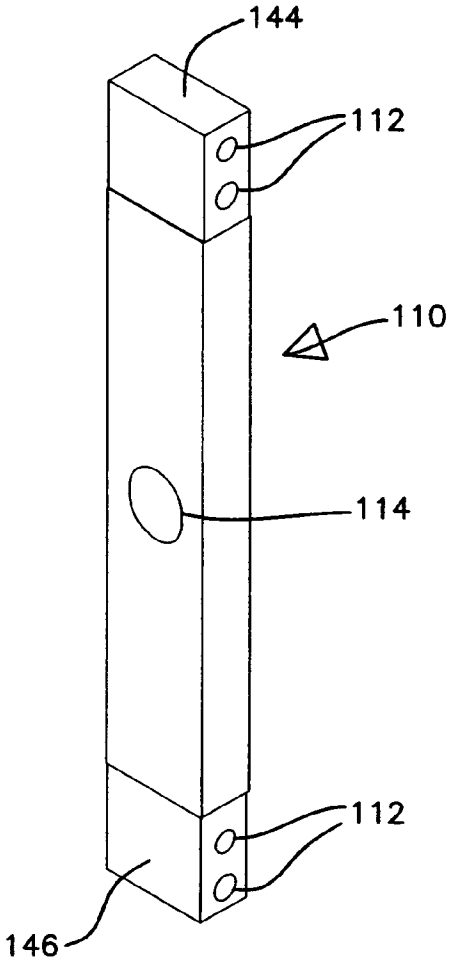
FIG. 6 is a perspective view of one embodiment of a through-member of the present invention.

Referring now to FIG. 6, the illustrated through-member 110 is generally a rectangular bar having apertures 112 located at each of the first and second ends 144, 146 of the through-member 110. The apertures 112 receive bolts for attaching the cutters 140 to the ends 144, 146 of the through-member 110. The through-member also includes a central aperture 114. Typically, the central aperture is configured to receive a centered shaft or other rod to provide a secondary locking mechanism, as disclosed in commonly assigned U.S. Pat. No. 6,422,495.

Figure 7:
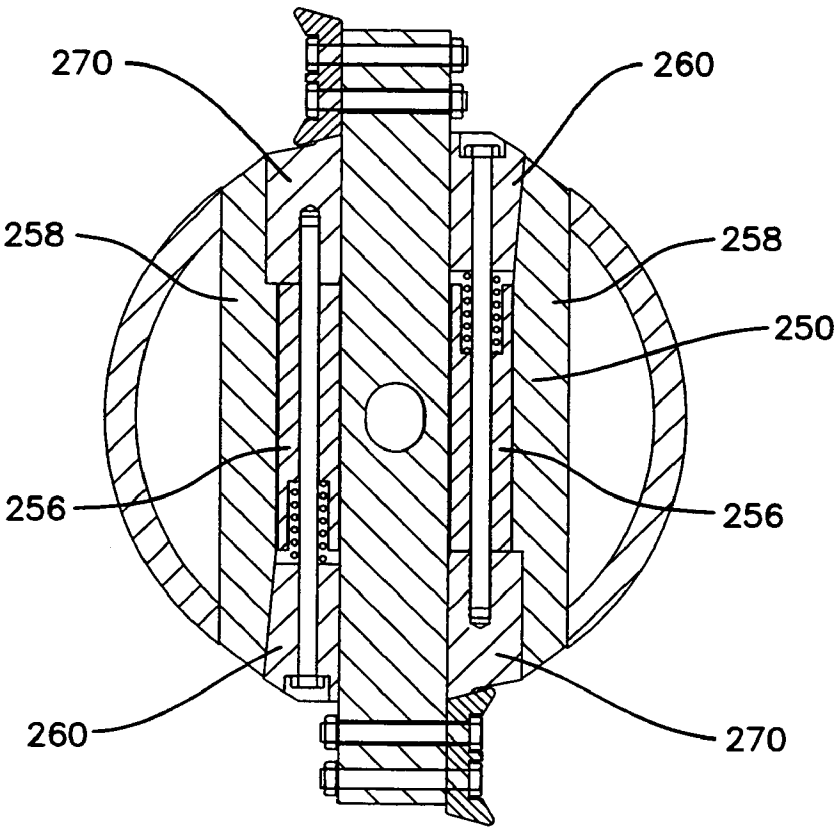
FIG. 7 is a cross-sectional view of an alternate embodiment of a drum of the present invention.
Figure 8:
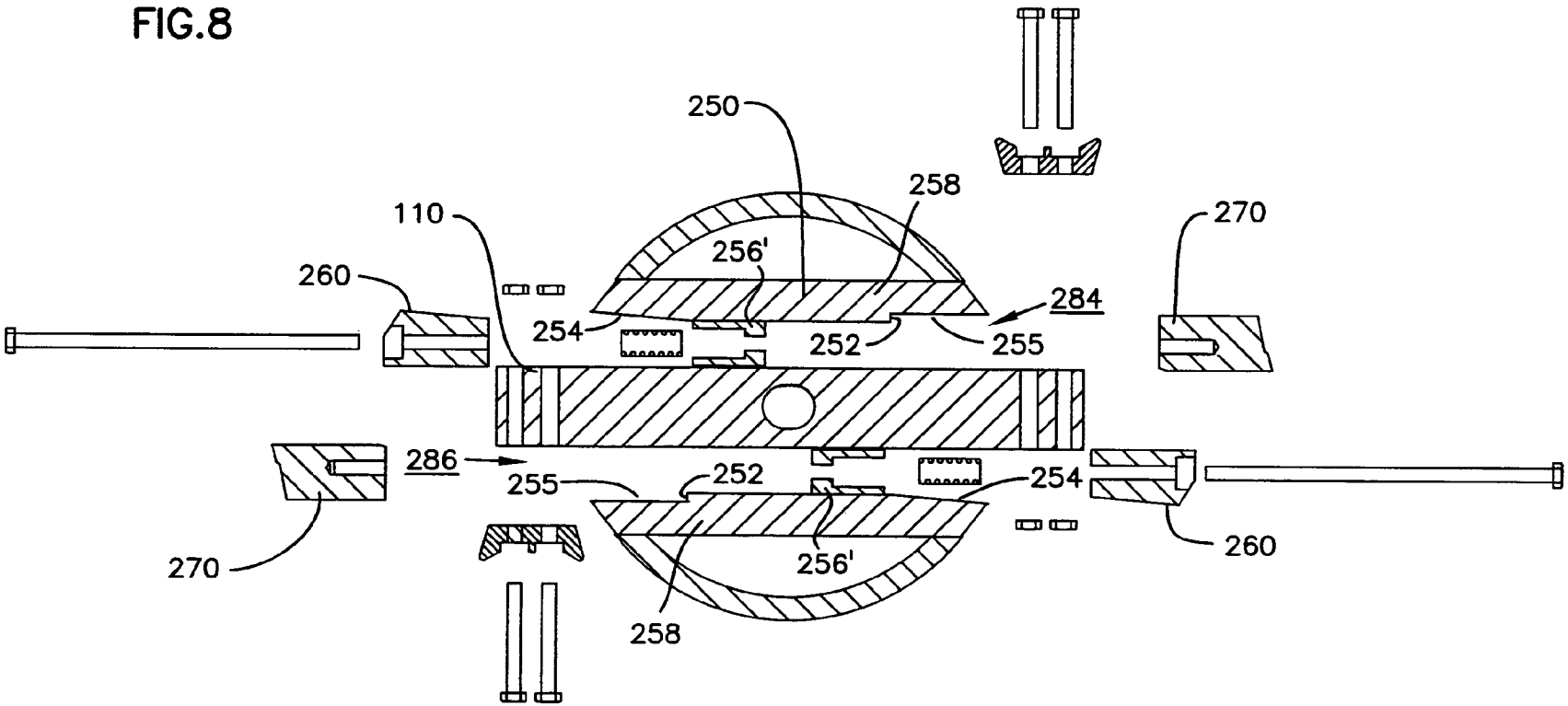
FIG. 8 is an exploded cross-sectional view of yet another embodiment of a drum of the present invention.

Referring now to FIGS. 7 and 8, an alternative embodiment of a sleeve 250 is illustrated. In this embodiment, the sleeve 250 is similar to the first sleeve embodiment 150, with the exception that the first and second pockets 284, 286 of the sleeve 250 are not symmetrical. In particular, outer structures 258 of the sleeve 250 have a first tapering surface 254 and a second opposite surface 255. The second opposite surface is not tapering, rather, is generally parallel to the through-member 110 when assembled. This arrangement allows the front block 270 to be manufactured with parallel sides, which can reduce manufacturing costs.

The second opposite surface 255 adjoins a shoulder surface 252. The shoulder surface 252 acts as a locating surface when front blocks 270 are inserted within the respective pocket 284, 286 of the sleeve 250. The spacer 256 of this second embodiment can either be constructed similar to the previous embodiment, as shown in FIG. 7, or can be shortened as shown in FIG. 8. The shortened embodiment of the spacer 256' is feasible by the locating function of the shoulder surface 252.

Figure 9:
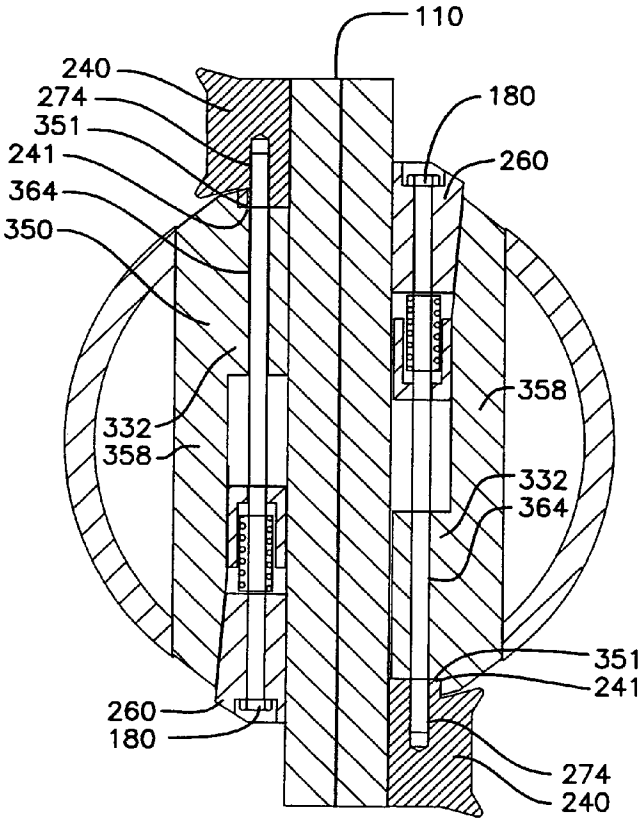
FIG. 9 is a cross-sectional view of another alternative embodiment of a drum of the present invention.

Referring now to FIG. 9, another alternative embodiment of a sleeve 350 is illustrated. In this embodiment, the front blocks have been eliminated; and cutters 240 incorporate features such as a threaded hole 274 for engagement with the bolt 180. The cutters 240 further include a locating surface 241 that mates to a shoulder surface 351 of outer structures 358 of the sleeves 350.

Each of the outer structures 358 includes a hole 364 that extend through a widened portion 332 of the outer structure 358. The widened portions 332 generally functions as integral front blocks to properly locate the cutters 240 and the through-member 110.

Figure 10:
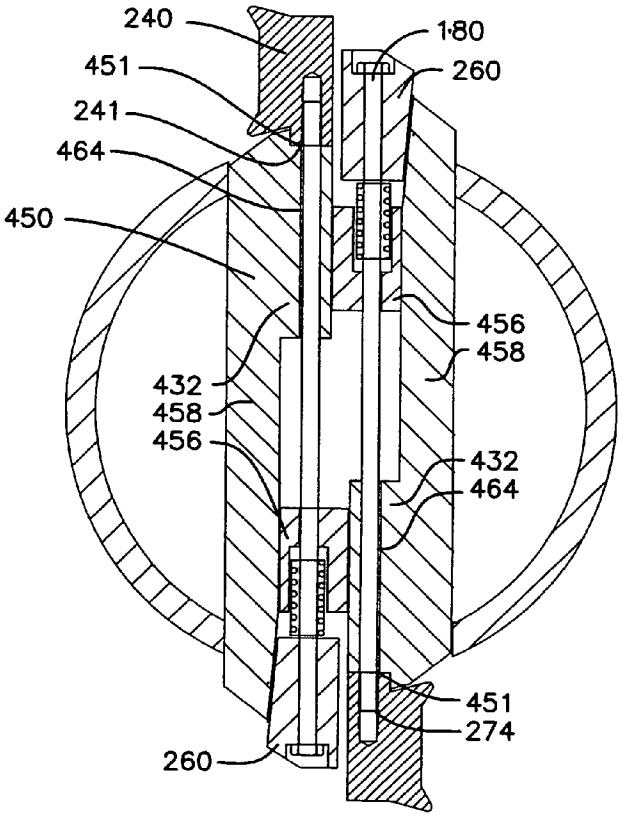
FIG. 10 is a cross-sectional view of yet another alternative embodiment of a drum of the present invention.

FIG. 10 illustrates still another embodiment of a sleeve 450. The sleeve 450 also eliminates the need for front blocks; in addition, the through-member has been eliminated. Specifically, similar to the embodiment shown in FIG. 9, the cutters 240 include the threaded hole 274 for engagement with the bolt 180. Locating surfaces 241 of the cutters 240 mate with shoulder surfaces 451 of outer structures 458 of the sleeve 450. Each of the outer structures 458 also includes a widened portion 432 having a hole 464 through which the bolt 180 extends. In contrast to the embodiment of FIG. 9, spacers 456 are configured and arranged to contact the widened portion 432 of the opposing outer structure, rather than a through-member. Because the through-member has been eliminated, the sleeve 450 is subsequently narrower than the other sleeve embodiments.

Referring now to FIGS. 11-14, a different style cutter 340, through-member 310, 410 and sleeve 450 are shown in accord with the principles of the present disclosure. In this embodiment, the cutter 340 is a plate, which may or may not include apertures for fastening to the through-member 310, 410. The cutters 340 can include hardfacing, and include any various configuration of tip as well known.

Figure 11:
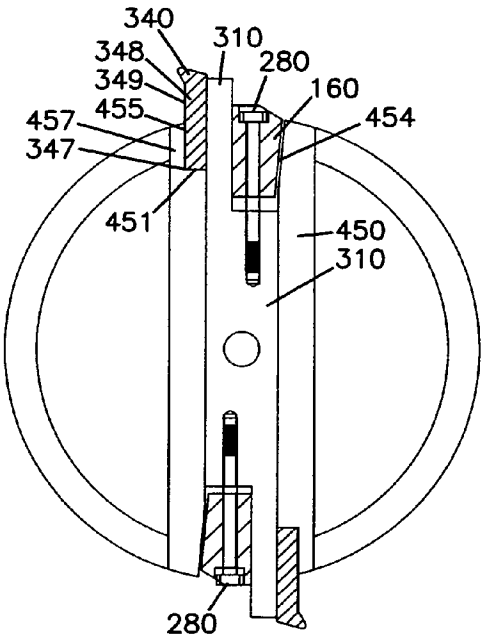
FIG. 11 is a cross-sectional view of still another alternative embodiment of a drum of the present invention.

In FIG. 11, the cutter 340 is wedged against the sleeve 450 by through-member 310 and the rear block 160. In particular, the rear block 160 is positioned between the through-member 310, 410 and a first tapering surface 454 of the sleeve 450. The rear block 160 is pulled towards the center of the drum by tightening bolts 280. At an end 457 opposite the first tapering surface 454, the sleeve 450 includes a shoulder 451 that positively locates the cutter 340. The cutter 340 may be constructed such that a bottom portion 347 is thicker than a middle portion 348. The sleeve 450 may also include a mating surface 455 that is parallel to a surface 349 of the cutter such that cutter 340 is positively locked into engagement.

Figure 12:
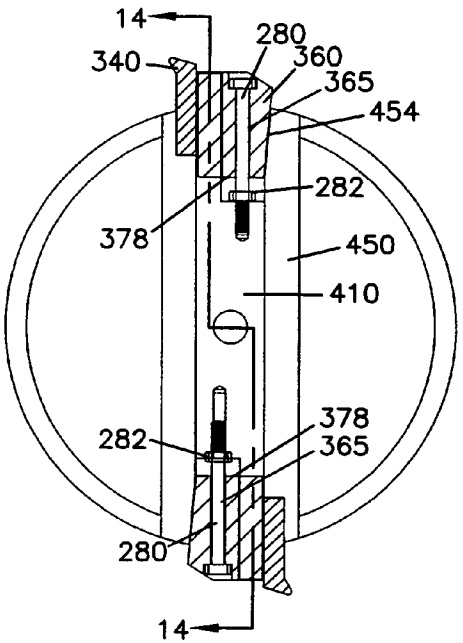
FIG. 12 is a cross-sectional view of another alternative embodiment of a drum of the present invention.
Figure 13:
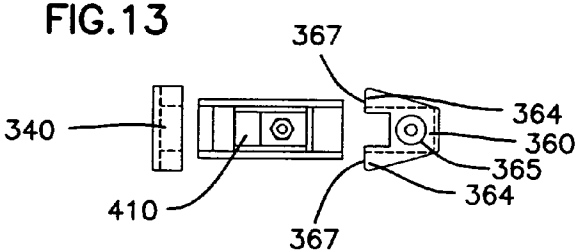
FIG. 13 is an exploded top plan view of some of the components illustrated in FIG. 12.
Figure 14:
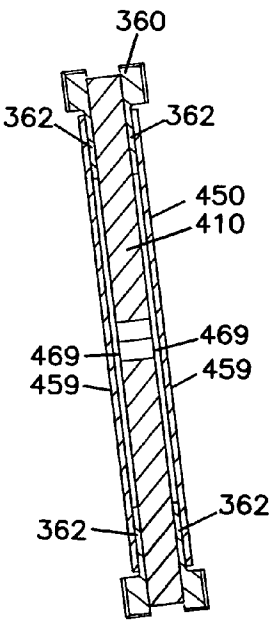
FIG. 14 is a cross-sectional view of a sleeve, through-member and blocks of FIG. 13, taken along line 14-14.

Referring now to FIGS. 12-14, an embodiment similar to that of FIG. 11 is shown. In this embodiment, however, the through-member 410 is narrowed, such that it is not as wide as the sleeve 450. In particular, as shown in FIG. 14, there is a gap 469 between the through-member 410 and side plates 459 of sleeve 450. At each end of the sleeve 450, a rear block 360 includes tabs 362 that extend into that gap to positively locate the through-member 410.

FIG. 13 illustrates the components shown in FIGS. 12 and 14, in exploded orientation. As illustrated, the rear block 360 includes wings 364 that extend outward and wrap around the through-member 410. Edges 367 of the wings 364 are configured to contact and support the cutter 340 when the cutter 340 and rear block 360 are assembled to the through-member 410 (FIG. 12).

Still referring to FIG. 12, a spacer 282 is affixed to each of the bolts 280 to assist in removal of the rear blocks 360. As can be understood, during assembly, the bolt 280 is positioned within a through hole 365 of the rear block 360. The spacer 282 is permanently affixed to the bolt 280 at a position such that the spacer 282 does not contact through-member 410, even when rear block 360 is inserted into an extreme position, as allowed by the first tapering surface 454. During removal of the rear block 360, the bolt 280 is unthreaded from the through-member 410, causing spacer 282 to move closer toward the rear block 360. As bolt 280 is further unthreaded, the spacer 282 contacts a bottom surface 378 of the rear block 360, forcing the rear block 360 out from the wedged engagement with the sleeve 450. In this manner, the bolt 280 and spacer 282 are used to both tighten the rear block 360 and to loosen the rear block.

Figure 16:
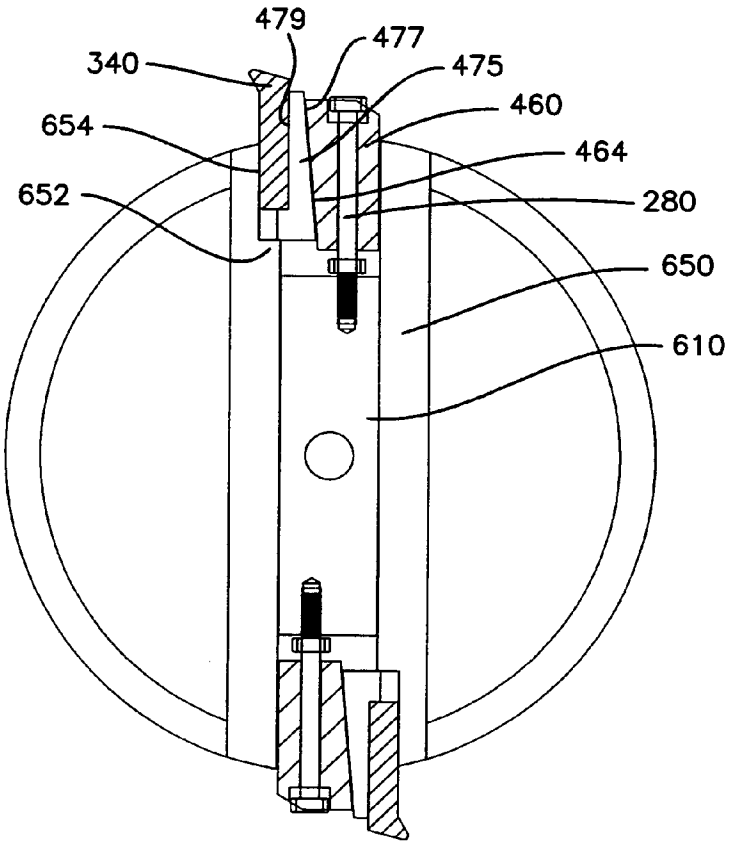
FIG. 16 is a cross-sectional view of still another alternative embodiment of a drum of the present invention.
Figure 15:
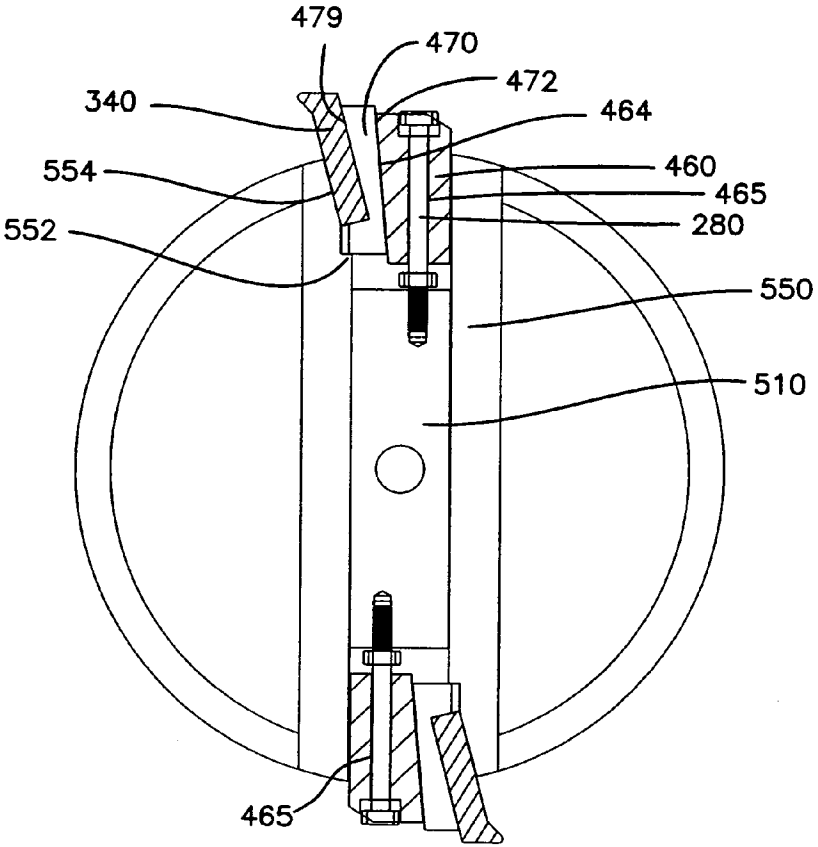
FIG. 15 is a cross-sectional view of yet another alternative embodiment of a drum of the present invention.

FIGS. 15 and 16 illustrate the principles of the present invention, as implemented in another alternative embodiment of a sleeve 550, 650 that supports the plate-style cutters 340.

Referring to FIG. 15, the sleeve 550 is used in combination with a rear block 460, a front block 470 and a center member 510. The sleeve 550 is configured without a tapering surface used for wedging. Rather, the wedging feature is provided by a tapered surface 464 of the rear block 460 and a tapered surface 472 of the front block 470. The front block 470 is held in position by a shoulder 552 of the sleeve 550. The arrangement results in the tapered surface 472 forming an opening taper. The rear block 460 includes a through hole 465 for receipt of the bolt 280 that draws the rear block 460 towards the center of the drum. As the bolt 280 is threaded into the center member 510, the front block 470 is held stationary by the shoulder 552 of the sleeve 550. As the rear block 460 is drawn towards the center of the drum, the front block 470 moves in a direction to trap the cutter 340 between a front side 479 of the wedge member 470 and a surface 554 of the sleeve 550. In the illustrated embodiment, the surface 554 of the sleeve 550 is angled such that the cutter 340 is oriented in an angle position when assembled.

Referring to FIG. 16, the sleeve 650 is used in combination with the rear block 460, a front block 475, and a center member 610. Similar to the sleeve 550 of FIG. 15, the sleeve 650 of FIG. 16 is also configured without a tapering surface used for wedging. The wedging feature is provided by the tapered surface 464 of the rear block 460 and a tapered surface 477 of the front block 475. The front block 475 is held in position by a shoulder 652 of the sleeve 650. As the rear block 460 is drawn towards the center of the drum by the bolt 280, the front block 475 moves in a direction to trap the cutter 340 between a front side 479 of the wedge member 477 and a surface 654 of the sleeve 650. In the illustrated embodiment, the surface 654 of the sleeve is angled such that the cutter 340 is in a generally perpendicular orientation when assembled.

Figure 18:
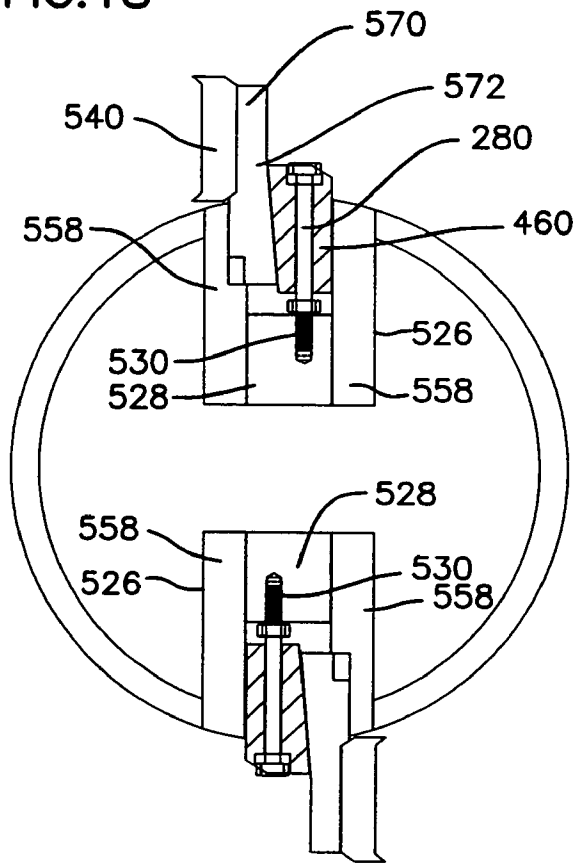
FIG. 18 is a cross-sectional view of yet another alternative embodiment of a drum of the present invention.
Figure 17:
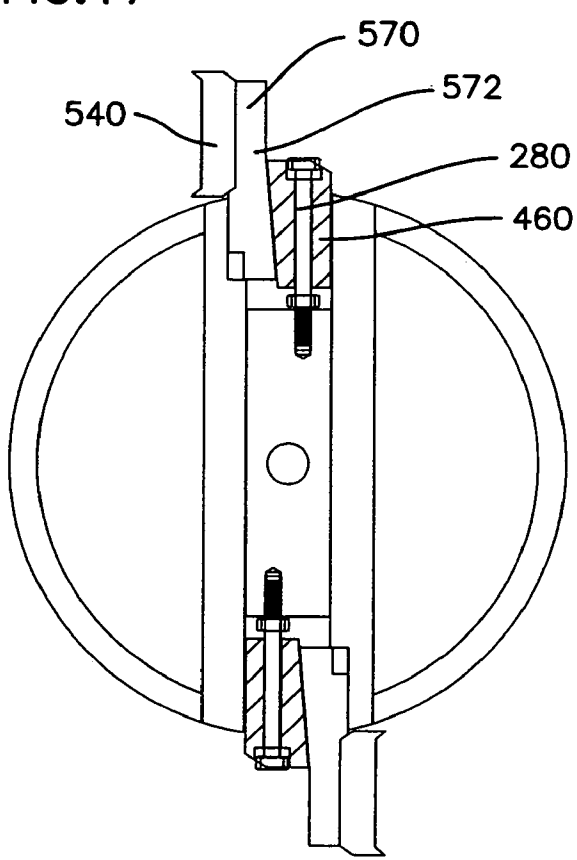
FIG. 17 is a cross-sectional view of another alternative embodiment of a drum of the present invention.

FIG. 17 illustrates another embodiment similar to that shown in FIGS. 15 and 16 having the rear block 460 configured to receive the bolt 280. In this embodiment, a front block 570 is adapted to support a bolted-on cutter 540. The front block 570 includes a surface 572 that forms an opening taper. Referring to FIG. 18, an alternative embodiment incorporating the front block 570 and bolted-on cutter 540 is illustrated. In this embodiment, the through-member has been eliminated. Instead, pockets 526 are formed within the drum. The pockets 526 are configured to accept the rear block 260 and the front blocks 570. Each of the pockets 526 includes outer structures 558 and a cross member 528 having a threaded hole 530 for connection with the bolt 280.

Figure 19:
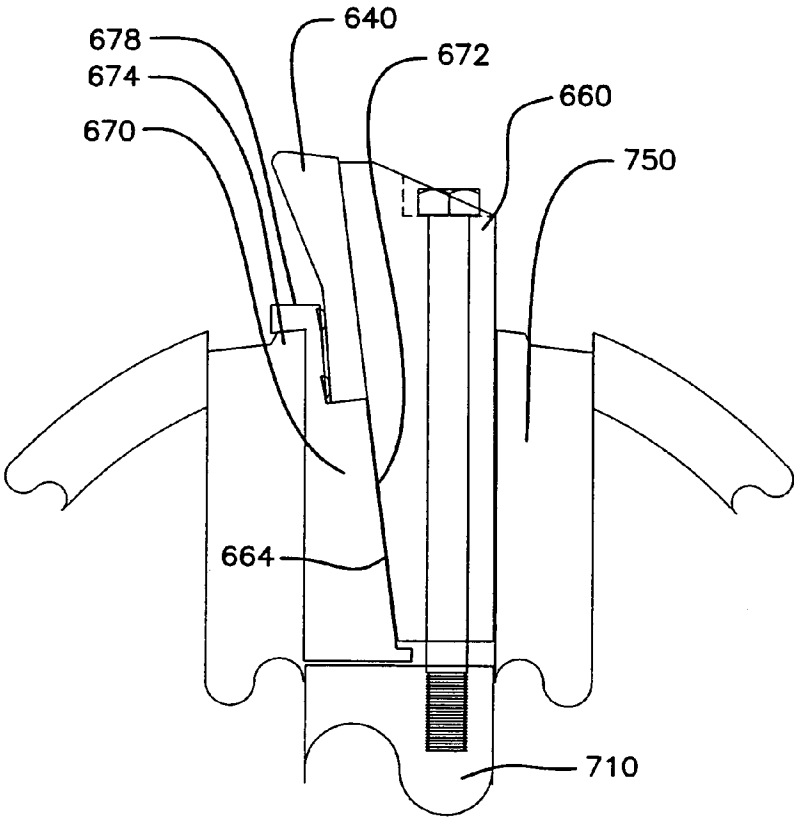
FIG. 19 is a cross-sectional view of still another alternative embodiment of a drum of the present invention.

FIG. 19 illustrates yet another embodiment in accord with the principles of the present disclosure. This arrangement includes a rear block 660, a front block 670, and a center member 710. In this embodiment, the front block 670 is configured for use with an existing sleeve 750 having a support shoulder 674, similar to the sleeve 30 illustrated in FIG. 1. The front block 670 has a flange portion 678 that contacts the support shoulder 674 of the sleeve 750. Each of the front and rear blocks 670, 660 have mating surfaces 672, 664 that contact one another. When the front block 670 is positioned adjacent to the sleeve 750, the mating surface 672 of the front block 670 forms an opening taper. A cutter 640 is interconnected to the rear block 660 and supported by the flange portion 674 of the front block 670.

Figure 20:
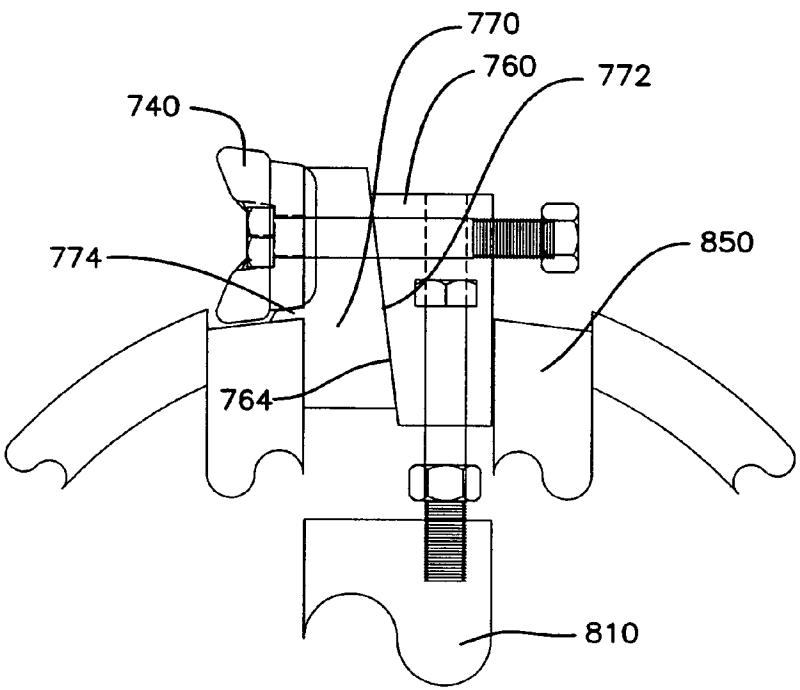
FIG. 20 is a cross-sectional view of another alternative embodiment of a drum of the present invention.

FIG. 20 illustrates still another embodiment in accord with the principles of the present disclosure. This arrangement includes a rear 760, a front block 770, and a center member 810. In this embodiment, the front block 770 is configured for use with a sleeve 850 that does not include a support shoulder; rather a support shoulder structure 774 is incorporated into the front block 770. By incorporating the support shoulder structure 774 into the front block 770, the structure 774 can be replaced if worn, by replacement of the front block 770. Similar to the embodiment of FIG. 19, each of the front and rear blocks 770, 760 have mating surfaces 772, 764 that contact one another. When the front block 770 is positioned adjacent to the sleeve 850, the mating surface 772 of the front block 770 forms an opening taper. A cutter 740 is interconnected to the rear block 760 and supported by the support shoulder structure 774 of the front block 770.

Figure 21:
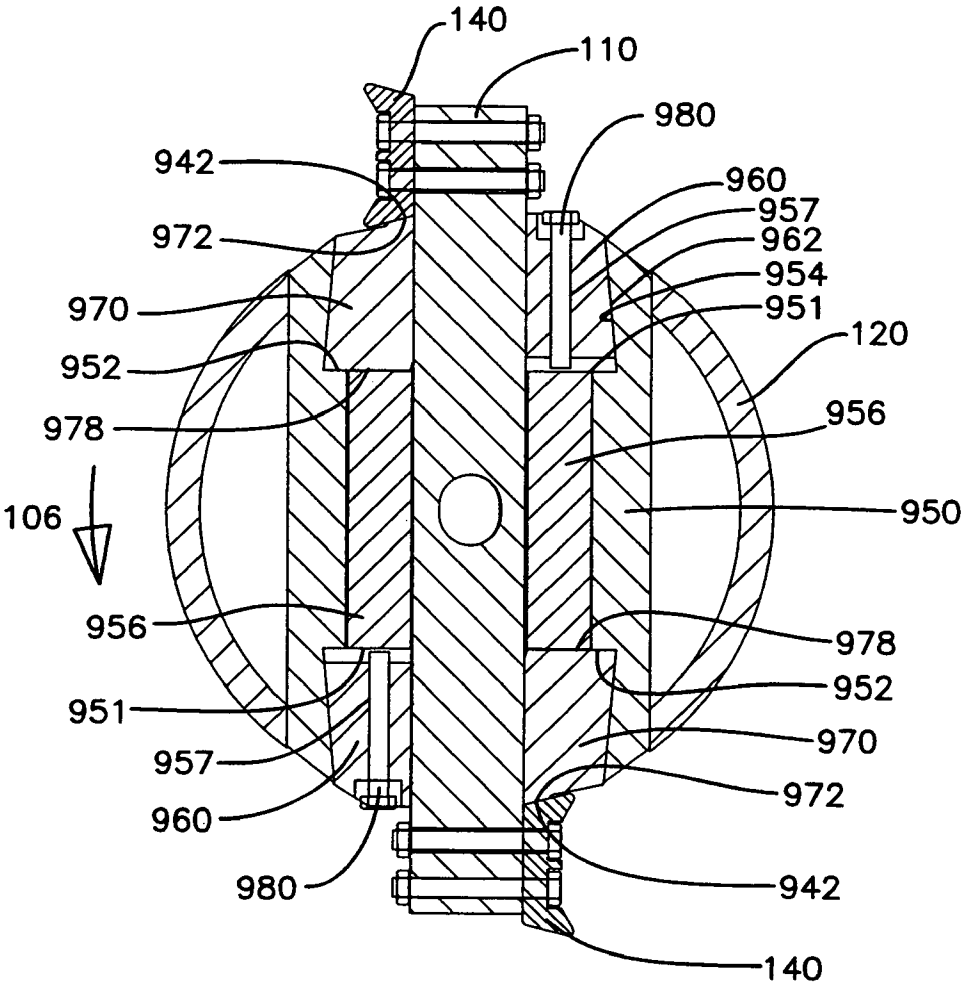
FIG. 21 is a cross-sectional view of yet another alternative embodiment of a drum of the present invention.

Referring now to FIG. 21 another embodiment including front and rear blocks 970, 960 arranged in combination with the through-member 110 is illustrated. In this arrangement, the direction of the taper defined by the front block 970 is reversed; that is the taper defined by the front block 970 forms a closing taper rather than an opening taper.

To assembly this embodiment, the front block 970 and rear block 960 are positioned within the sleeve 950. The front block 970 includes a bottom surface 978 that contacts a shoulder 952 of the sleeve 950. The through-member 110 is then positioned between the front and rear blocks 970, 960. To radially or axially locate the through-member 110, the cutter 140 is interconnected to the end of the through-member such that a locating surface 942 of the cutter 140 contacts a mating shoulder 972 of front block 970. The through-member 110 is then secured in this axial position by installing bolts 980 into threaded holes 957 of the rear blocks 960. When the bolts 908 are threaded through the threaded holes 957 of the rear blocks 960, the bolt 980 contacts surface 951 of a spacer 956 of the sleeve 950, and the rear block 960 is forced radially outward. As the rear block 960 is forced radially outward, a first tapering surface 954 of the sleeve 950 engages a cooperating tapering surface 962 of the rear block 960 to wedge or clamp the through-member 110 in position.

Figure 22:
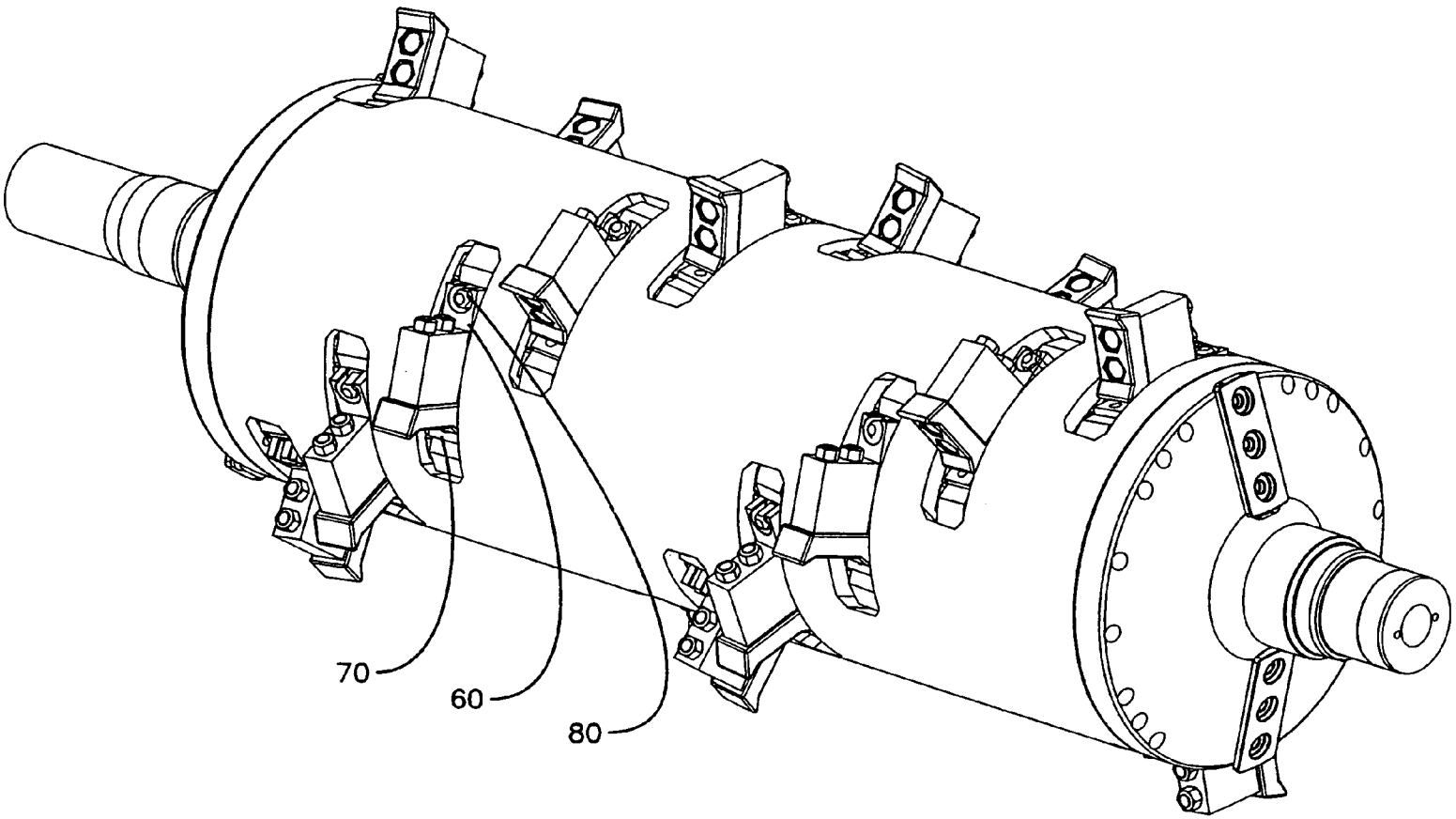
FIG. 22 is a perspective view of another embodiment of a drum of the present invention.
Figure 24:
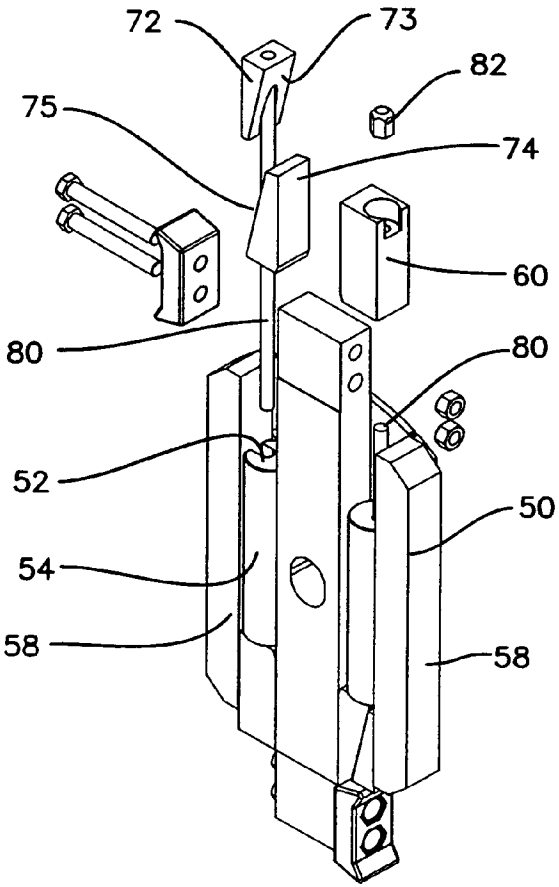
FIG. 24 is an exploded perspective view of some of the components illustrated in FIG. 23.
Figure 23:
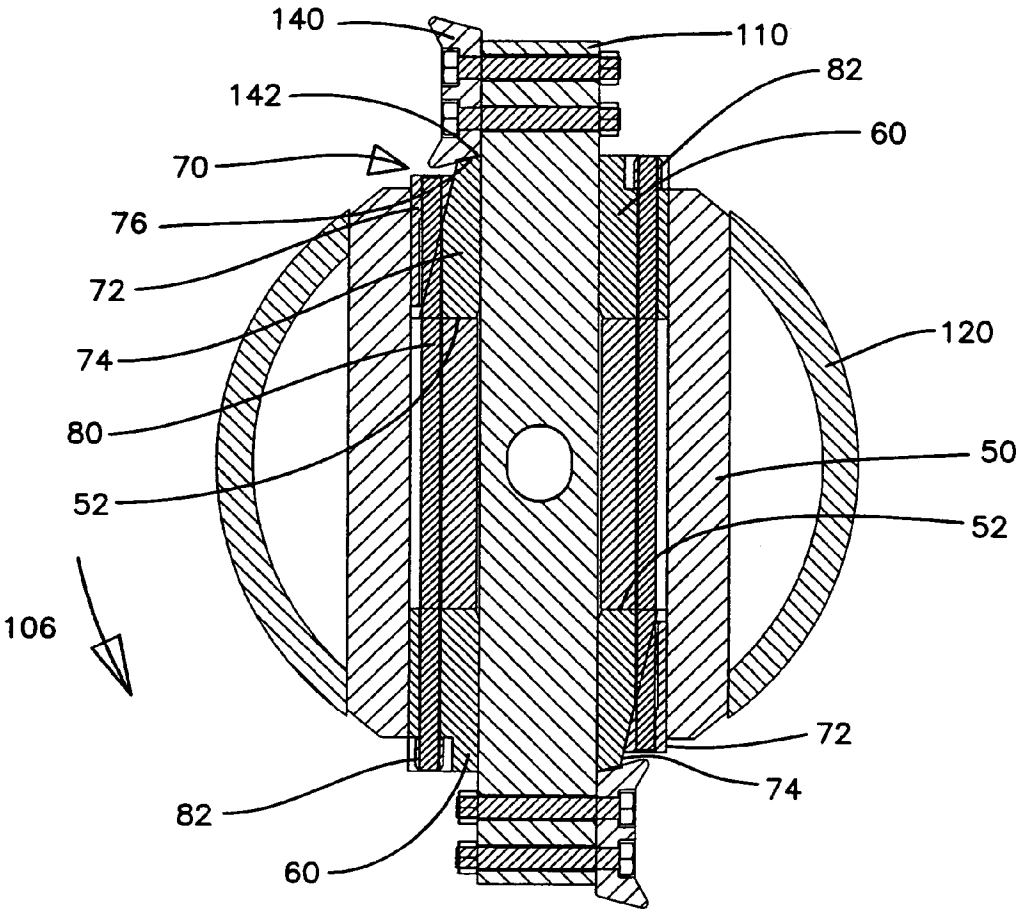
FIG. 23 is a cross-sectional view of the drum of FIG. 22, the viewing plane passing through a through-member.

Referring now to FIGS. 22-24 yet another embodiment of a rotary drum having a front block assembly 70, a rear block 60, and a nut 80 is illustrated. As shown in FIG. 23, the through-member 110 is secured in relation to the generally cylindrical drum skin 120 for rotation in direction 106. A sleeve 50 is permanently secured to the drum skin 120, passing from one side to the opposite side. The through-member 110 passes through the sleeve 50 and is located between the front block assembly 70 and the rear block 60.

The front block assembly 70 includes a front wedge member 72 and a rear wedge member 74. The rear wedge member 74 contacts a bottom surface 52 of a spacer or cylindrical tube 54 (FIG. 24). A supporting structure 76 of each rear wedge members 74 contacts a mating structure 142 of the cutter 140 secured to the through-member 110. In this manner, the through-member is properly located. The through-member 110 is then secured to the sleeve 50 when the front wedge member 72 is drawn into position by a threaded stud 80 that is threaded into the front wedge member 72, extends through the opposite rear block 60, and engages a nut 82.

As further illustrated in FIG. 24, the front wedge member 72 and the rear wedge member 74 include cooperating tapered surfaces 73 and 75 which interact to generate a clamping or wedging force such that the through-member 110 is retained by the rear wedge member 74 and the rear retaining blocks 160. The clamping force is generated as the front wedge member 72 is forced in a radial direction, as nut 82 is tightened, and front wedge member 74 is held in position by the bottom surface 52 of the spacer 54. In this illustrated embodiment, each of the spacers 54 is permanently joined to outer structures 58 of the sleeve 50.

Figure 25:
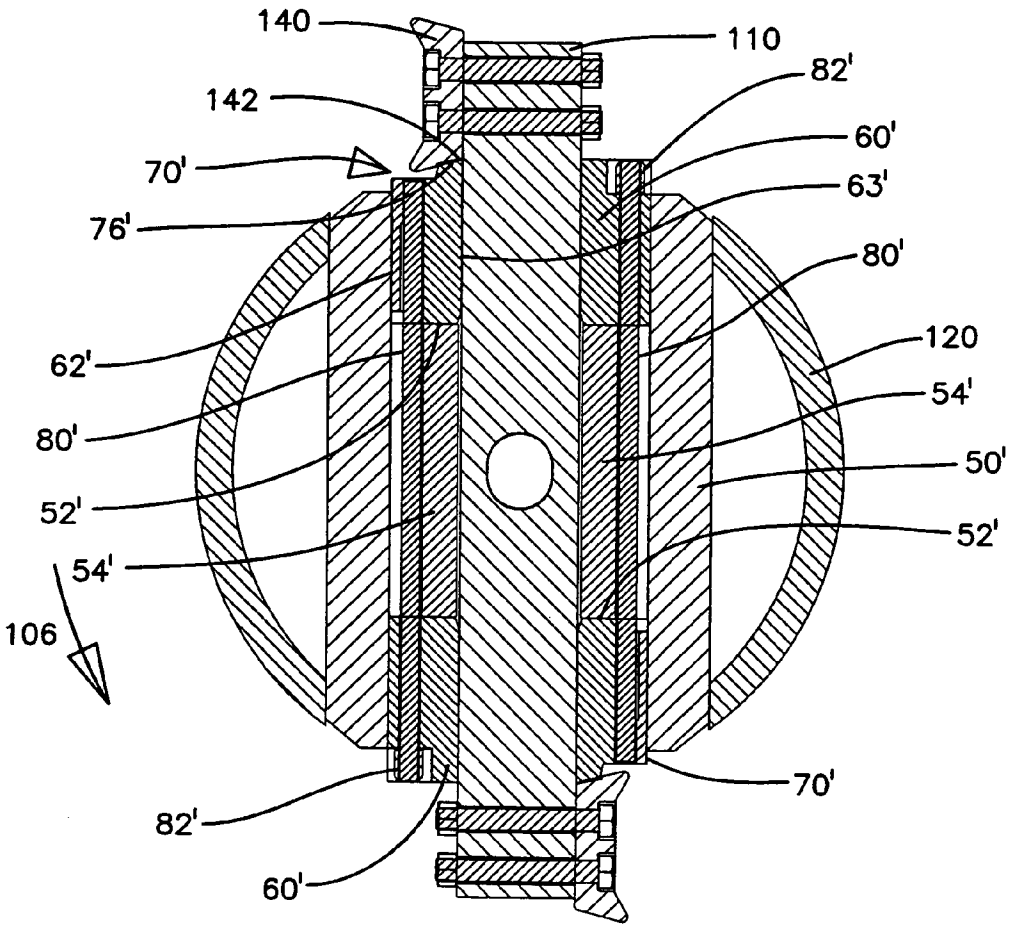
FIG. 25 is a cross-sectional view of still another alternative embodiment of a drum of the present invention.

Referring now to FIG. 25 still another embodiment of a rotary drum is illustrated. Similar to the previous embodiment, the through-member 110 is secured in relation to the generally cylindrical drum skin 120 for rotation in direction 106. A sleeve 50' is permanently secured to the drum skin 120, passing from one side to the opposite side. The through-member 110 passes through the sleeve 50' and is retained in the sleeve 50' by first and second front wedge members or blocks 70' and first and second rear wedge members or blocks 60'.

The front wedge members or blocks 70' contact a bottom surface 52' of spacers 54'. Likewise, the rear wedge members or blocks 60' contact an opposite bottom surface of the spacers 54'. In this illustrated embodiment, each of the spacers 54' is permanently joined, such as by a weldment, to the sleeve 50' (see FIG. 24 for a similar spacer/sleeve configuration).

A supporting structure 76' of the front blocks 70' contact a mating structure 142 of cutters 140 secured to the through-member 110. In this manner, the through-member is properly located. The through-member 110 is then secured within the sleeve 50' when each of the front blocks 70' and the rear blocks 60' are secured in a wedged position by a threaded stud 80'. In the illustrated embodiment, each of the threaded studs 80' engages threads formed in the front blocks 70' and extends through a hole formed in the rear blocks 60' to engage a threaded nut 82'. Other through hole and threaded hole configurations can be used to secure each of the blocks 70', 60' in the wedged position.

In the illustrated embodiment, both the front blocks 70' and the rear blocks 60' are generally rectangular shaped blocks. That is, none of the front and rear blocks 70', 60' have tapered surfaces, rather opposite first and second surfaces (e.g. 62', 63') of the block are generally parallel to one another. The clamping force that retains the through member 110 is generated by the fit of the front and rear blocks 70', 60' and the through member 110 within the pocket of the sleeve 50'.

The above specification provides a complete description of the invention. Since many embodiments of the invention can be made without departing from the spirit and scope of the invention, certain aspects of the invention reside in the claims hereinafter appended.

What is claimed is:

1. A rotary grinder, comprising:

a) a cylindrical body having an axis of rotation, the cylindrical body defining first and second receiving apertures;

b) a cutting element extending between the first receiving aperture and the second receiving aperture, the cutting element including cutters located outside of the cylindrical body;

c) a wedge positioned within the first receiving aperture between the cutting element and the cylindrical body; and d) a wedge tightening element having an end accessible at the second receiving aperture and an opposite end connected to the wedge positioned within the first receiving aperture;

e) wherein tightening the accessible end of the wedge tightening element at the second receiving aperture secures the cutting element in relation to the cylindrical body by wedging the wedge in the first receiving aperture between the cutting element and the cylindrical body.

2. The grinder of claim 1, wherein the wedge tightening element is a bolt, the opposite end of the bolt being a threaded end that engages a threaded hole formed in the wedge.

3. The grinder of claim 1, wherein the wedge is a first wedge, the grinder further including a second wedge positioned within the second receiving aperture between the cutting element and the cylindrical body.

4. The grinder of claim 3, wherein the accessible end of the tightening wedge element is positioned through a through hole formed in the second wedge.

5. The grinder of claim 4, wherein tightening the accessible end of the tightening wedge element pulls the first wedge and the second wedge toward one another.

6. The grinder of claim 1, further including a spacer positioned between the first and second receiving apertures, the spacer including a stop surface that limits wedging movement of the wedge.

7. The grinder of claim 1, further including a sleeve, the cutting element being positioned within the sleeve, the sleeve having a shoulder that limits wedging movement of the wedge.

8. A rotary grinder, comprising:

a) a cylindrical body having an axis of rotation, the cylindrical body defining first and second receiving apertures, the first and second receiving apertures extending through the cylindrical body from an exterior of the cylindrical body to an interior;

b) a cutting element having a first end and a second end, the first end extending beyond the exterior of the cylindrical body at the first receiving aperture, the second end extending beyond the exterior of the cylindrical body at the second receiving aperture; and c) a wedge arrangement including a first wedge located within the first receiving aperture, a second wedge located within the second receiving aperture, and a single wedge tightening element, the single wedge tightening element being arranged to pull the first and second wedges toward one another to generate a clamping force that secures the cutting element in relation to the cylindrical body.

9. The grinder of claim 8, wherein the single wedge tightening element is a threaded bolt having a threaded end that engages a threaded hole formed in the one of the first and second wedges.

10. The grinder of claim 8, wherein the single wedge tightening element has an end accessible at the one of the first and second receiving aperture and an opposite end connected to the wedge positioned within the other of the first and second receiving apertures.

11. The grinder of claim 10, wherein tightening the accessible end of the single wedge tightening element at the one receiving aperture pulls the first and second wedges in the first and second receiving apertures toward one another.

12. The grinder of claim 10, wherein the accessible end of the tightening wedge element is positioned through a through hole formed in the wedge positioned within the one of the first and second receiving apertures.

13. The grinder of claim 8, further including a spacer positioned between the first and second receiving apertures, the spacer including a stop surface that limits wedging movement of the wedges.

14. The grinder of claim 8, further including a sleeve, the cutting element being positioned within the sleeve, the sleeve having a shoulder that limits wedging movement of the wedges.

15. A rotary grinder, comprising:

a) a cylindrical body having an axis of rotation, the cylindrical body defining first and second receiving apertures;

b) a cutting element extending through the cylindrical body, the cutting element having a first cutting end located at the first receiving aperture and a second cutting end located at the second receiving aperture; and c) a retaining arrangement that secures the cutting element in relation to the cylindrical body, the retaining arrangement including:

i) a first block located within the first receiving aperture;

ii) a second block located within the second receiving aperture; and iii) a securing element that pulls at least one of the first and second blocks toward the other block;

iv) wherein the at least one block has non-parallel sides, the one block with non-parallel sides wedging between the cutting element and the cylindrical body to secure the cutting element in relation to the cylindrical body when the securing element pulls the one block toward the other block.

16. The grinder of claim 15, wherein the securing element is a threaded bolt having an accessible end and a threaded end, the threaded end being engaged with a threaded hole formed in one of the first and second blocks, the accessible end being located within a through hole formed in the other of the first and second blocks.

17. The grinder of claim 16, wherein the through hole is formed in the one block with non-parallel sides.

18. The grinder of claim 16, wherein the threaded hole is formed in the one block with non-parallel sides.

19. The grinder of claim 15, wherein each of the first and second blocks has non-parallel sides.

20. The grinder of claim 19, wherein the securing element pulls each of the first and second blocks towards one another.

* * * * *